US006609667B2

(12) United States Patent
Kiriki et al.

(10) Patent No.: US 6,609,667 B2
(45) Date of Patent: Aug. 26, 2003

(54) FUEL INJECTION NOZZLE

(75) Inventors: Yasunori Kiriki, Chiryu (JP); Takashi Iwanaga, Toyohashi (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 10/073,234

(22) Filed: Feb. 13, 2002

(65) Prior Publication Data

US 2002/0109021 A1 Aug. 15, 2002

(30) Foreign Application Priority Data

Feb. 14, 2001 (JP) ..... 2001-036377

(51) Int. Cl.[7] ..... F02M 39/00
(52) U.S. Cl. ..... 239/533.3; 239/88; 239/533.2
(58) Field of Search ..... 239/533.2, 533.12, 239/88–96, 124–127, 585.1–585.5; 123/470

(56) References Cited

U.S. PATENT DOCUMENTS 4,890,794 A * 1/1990 Imafuku et al. ..... 239/533.12
4,892,065 A * 1/1990 List ..... 239/533.3
5,556,031 A * 9/1996 Cooke et al. ..... 239/533.8

FOREIGN PATENT DOCUMENTS

JP 7-119583 * 5/1995

* cited by examiner

*Primary Examiner*—Michael Mar
*Assistant Examiner*—Dinh Q. Nguyen
(74) *Attorney, Agent, or Firm*—Nixon & Vanderhye P.C.

(57) ABSTRACT

In a fuel injection nozzle for an internal combustion engine, a frictional force reducing member is interposed between a seating surface of a shoulder portion of a nozzle body and an inner seating surface of a bearing portion of a retaining nut, whereby a frictional force developed between both seating surfaces and can be diminished without performing a high-degree of surface machining on the inner seating surface of a bearing portion of the retaining nut, even if the surface roughness of the inner seating surface of a bearing portion of the retaining nut is large. Consequently, it is possible to prevent deformation of a slide portion of the nozzle needle which is attributable to a twist of the nozzle body caused by frictional force.

10 Claims, 2 Drawing Sheets

FUEL INJECTION NOZZLE

CROSS REFERENCE TO RELATED APPLICATION

This application is based on and incorporates herein by reference Japanese Patent Application No. 2001-36377 filed on Feb. 14, 2001.

BACKGROUND OF THE INVENTION

1. Technical Field of the Invention

The present invention relates to a fuel injection nozzle for an internal combustion engine, such as a diesel engine, in which the nozzle is attached to each cylinder of the internal combustion engine.

2. Description of Related Art

Recently, in general, with respect to a fuel injection nozzle for an internal combustion engine, such as a diesel engine with high fuel injection pressures, it has been desired to improve a clamping axial force of a clamping member such as a retaining nut in order to ensure a seal during high-pressure conditions between a sealing surface of a nozzle body and that of a nozzle holder.

As shown in FIG. 2, however, when a retaining nut 103 is tightened to clamp a nozzle body 101 and a nozzle holder with each other, a frictional force is developed on a friction generating interface 104 located between a seating surface of a shoulder portion of the nozzle body 101 and an inner seating surface of the retaining nut 103. With this frictional force, the nozzle body 101 twists, so that the cylindricality of a nozzle needle slide portion 105 deteriorates and there is a fear that a defective slide of the nozzle needle 106 may occur. In this case, a countermeasure is to improve the surface smoothness of the inner seating surface of the retaining nut 103. However, it is very difficult to apply a high-degree of surface machining to the inner seating surface of the retaining nut 103 and there arises the problem that the cost increases.

SUMMARY OF THE INVENTION

It is an object of the present invention to provide a fuel injection nozzle capable of preventing a defective slide of a nozzle needle by decreasing a frictional force developed between a seating surface of a shoulder portion of a nozzle body and an inner seating surface of a bearing portion of a retaining nut at the time of clamping.

According to an embodiment of the invention, a frictional force reducing member is interposed between a seating surface of a shoulder portion of a nozzle body and an inner seating surface of a bearing portion of a retaining nut to reduce a frictional force developed between both seating surfaces at the time of clamping. With the frictional force reducing member, the frictional force induced between both seating surfaces can be diminished without performing a high-degree of surface machining to the inner seating surface of the bearing portion of the retaining nut, even if the surface roughness of the inner seating surface is large. Consequently, a nozzle needle slide portion can be prevented from being deformed by a twist of the nozzle body which is caused by the frictional force and hence it is possible to avoid a defective slide of the nozzle needle.

Additionally, a flat plate-like member, which has a small frictional coefficient, at least at an end face thereof, located on the nozzle body side, is used as the frictional force reducing member. Furthermore, a metallic member having a hardness equal to that of the nozzle body or the retaining nut can used as the flat plate-like member. Additionally, the flat plate-like member can be a resin member, however, there is a fear of it being melted upon exposure to a high temperature combustion gas. Therefore, a metallic member may be much more advantageous.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The invention, together with additional objectives, features and advantages thereof, will be best understood from the following description, the appended claims and the accompanying drawings in which:

DETAILED DESCRIPTION OF PREFERRED EMBODIMENTS

The following description of the preferred embodiment(s) is merely exemplary in nature and is in no way intended to limit the invention, its application, or uses.

Figure 1:
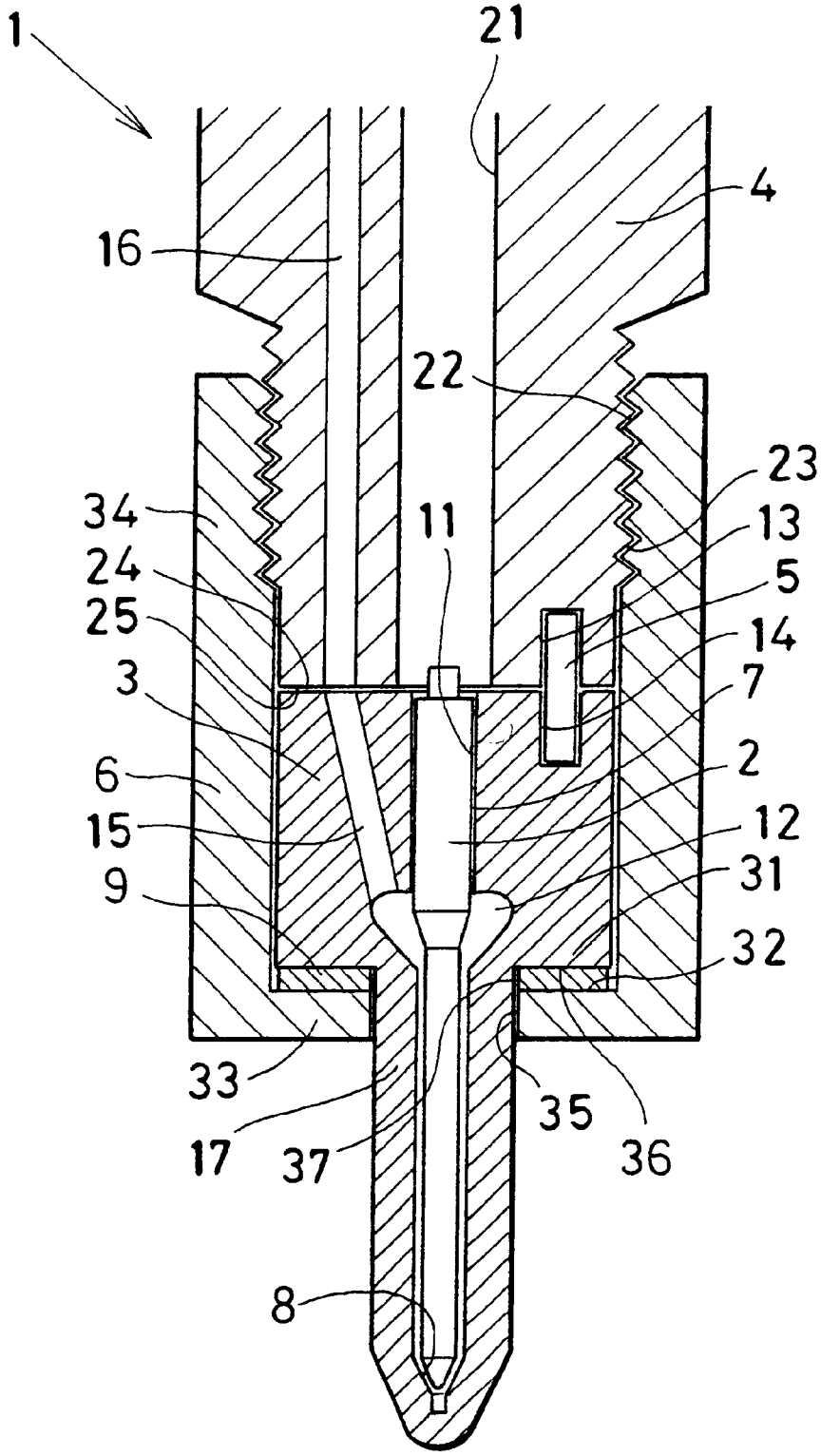
FIG. 1 is a cross-sectional view showing a main structure of a fuel injection nozzle for an internal combustion engine.
Figure 2:
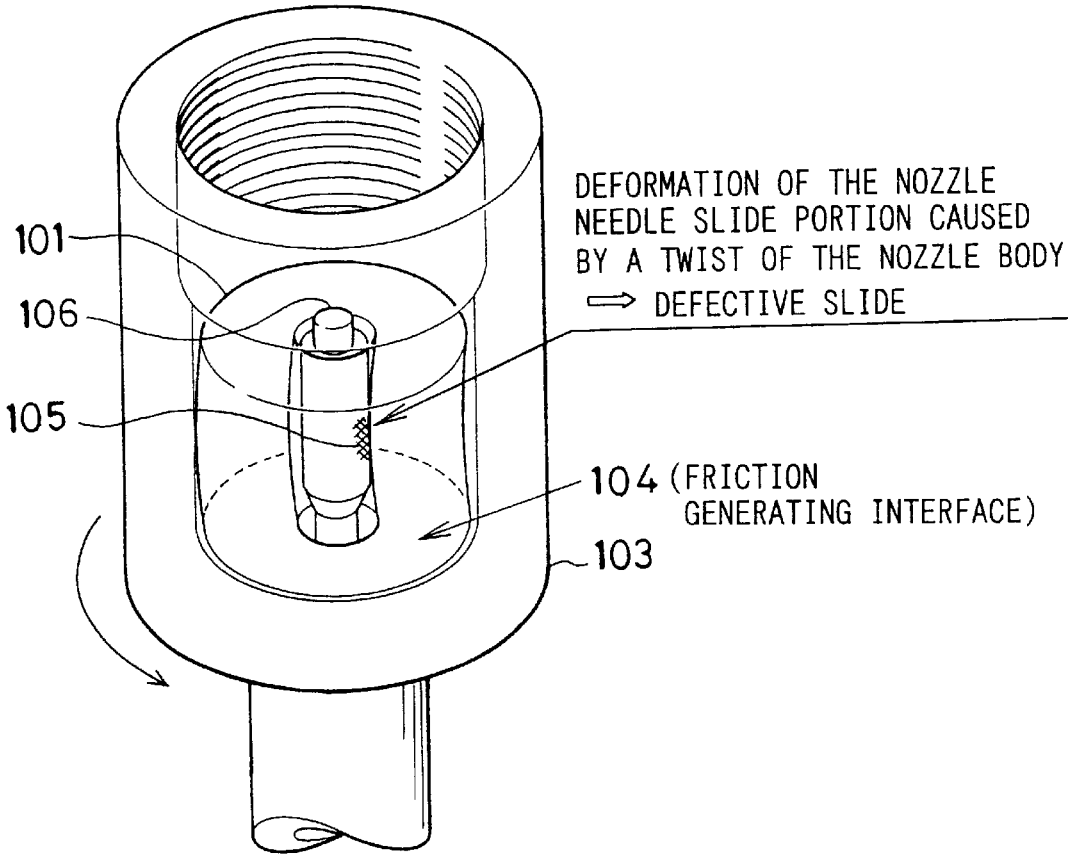
FIG. 2 PRIOR ART
FIG. 2 is a schematic diagram of the prior art showing a deformed state of a slide portion caused by a twist of a nozzle body of a fuel injection nozzle for an internal combustion engine.

FIG. 1 illustrates a main structure, shown in cross-sectional view, of a fuel injection nozzle for an internal combustion engine according to an embodiment of the present invention. The fuel injection nozzle 1, according to this embodiment, is an injector used in an accumulator type fuel injection system (a common rail system). The injector is typically attached to each cylinder of a diesel engine (not shown). The fuel injection nozzle 1 is a direct-injection type wherein a high-pressure fuel fed under pressure from a high-pressure supply pump (not shown) is accumulated within an accumulator in a common rail system and the thus-accumulated high-pressure fuel is injected as a mist directly into a combustion chamber. The fuel injection nozzle 1 for an internal combustion engine is made up of a nozzle body 3 which houses a nozzle needle 2, a nozzle holder 4 which houses an urging means such as a spring for urging the nozzle needle 2 to a valve closing side, a dowel pin 5 for positioning and for the prevention of rotation at the time of mounting the nozzle body 3 and the nozzle holder 4, and a retaining nut 6 for making a close-contact surface (sealing surface) of the nozzle body 3 and that of the nozzle holder 4 come into close contact via a predetermined clamping axial force.

The nozzle needle 2 is in the shape of a rod having a slide portion 7 which is slidably supported within a slide hole 11 formed in the nozzle body 3. A front end portion (the lower end side in FIG. 1) of the nozzle needle 2 engages or disengages from a valve seat 8 of the nozzle body 3 to close or open a fuel injection hole to be described later (not shown). One end portion of a hydraulic piston or a pressure pin (neither shown) is connected to an upper end portion of the nozzle needle 2.

At the opposite end portion of the hydraulic piston or the pressure pin is formed a hydraulic control chamber (not shown) to and from which oil pressure is fed and discharged by means of an electromagnetic actuator such as a solenoid valve (not shown). When oil pressure is extracted from the hydraulic control chamber, the nozzle needle 2 and the hydraulic piston or the pressure pin moves (lifts) axially against the biasing force of an urging means such as a spring or the like. That is, the nozzle needle 2 opens. When oil pressure is introduced into the hydraulic control chamber, the nozzle needle 2 and the hydraulic piston or the pressure pin moves axially under the urging force of the urging means such as a spring, so that the nozzle needle 2 closes.

The nozzle body 3 has a first cylindrical body provided on its front end side (the lower side in FIG. 1) with one or more fuel injection holes (not shown) for the injection of a high-pressure fuel. In the interior of the nozzle body 3 is formed a slide hole 11 for slidably holding the rod-like nozzle needle 2. In an intermediate position of the slide hole 11 is formed an oil sump 12 as an enlarged-diameter portion. In an upper end face (a close-contact surface for close contact with the nozzle holder 4) in the figure of the nozzle body 3 is formed a pin hole 14, the pin hole 14 communicating with a pin hole 13 (to be described later) formed in the nozzle holder 4 and allowing the dowel pin 5 to be fitted therein. A single dowel pin 5 interconnects upper and lower pin holes 13 and 14. In this embodiment, two dowel pins are disposed radially opposite to each other with respect to an axis of the fuel injection nozzle. One of them is not shown in the figures.

In the nozzle body 3 is formed a fuel delivery passage 15 (corresponding to the first fuel passage in an embodiment of the present invention) extending from an upper end side in FIG. 1 of the nozzle body to the oil sump 12. The fuel delivery passage 15 communicates with a fuel feed passage 16 formed in the nozzle holder 4, thereby constituting a fuel passage for feeding a high-pressure fuel from an accumulator in a common rail system into the oil sump 12.

The nozzle holder 4 has a second cylindrical body provided in the interior thereof with a spring chamber 21 which houses an urging means (not shown) such as a spring and which also receives therein a hydraulic piston or a pressure pin connected to the nozzle needle 2. In a lower end face (a close-contact surface for close contact with the nozzle body 3) in the figure of the nozzle holder 4 is formed a pin hole 13, the pin hole 13 communicating with the pin hole 14 and allowing the dowel pin 5 to be fitted therein. The nozzle holder 4 is provided with a joint portion (not shown) to receive a high-pressure oil which is fed from the common rail system through a high-pressure pipe (not shown).

A fuel feed passage 16 (corresponding to the second fuel passage in the present invention) is formed in the interior of the joint portion of the nozzle holder 4 and around the spring chamber 21 to deliver a high-pressure fuel to the oil sump 12 through the fuel delivery passage 15. Further, a fuel relief passage (not shown) is formed in the nozzle holder 4 to let the fuel conducted into the spring chamber 21 flow back into a low-pressure pipe such as a fuel tank. An externally threaded portion 23 to be engaged with an internally threaded portion 22 to be described later of the retaining nut 6 is formed in a lower end-side outer periphery in FIG. 1 of the nozzle holder 4. The close-contact surface located on the lower end side in FIG. 1 of the nozzle holder 4 is provided with a sealing surface 25 to ensure high-pressure sealability between sealing surface 25 and a close-contact surface (sealing surface) 24 located on the upper end side in the figure of the nozzle body 3.

The retaining nut 6 is for making the upper end-side close-contact surface in FIG. 1 of the nozzle body 3 and the lower end-side close contact surface in the figure of the nozzle holder 4 come closely into contact with a predetermined clamping axial force. The retaining nut 6 is provided with an annular bearing portion 33 having an inner seating surface 32 for bearing a shoulder portion 31 formed at the lower end face of the nozzle body 3 and is also provided with an annular sleeve portion 34 extending upward in the figure from an outer peripheral end of the bearing portion 33. An upper inner peripheral portion of the sleeve portion 34 is internally threaded at 22 for engagement with the externally threaded portion 23 formed on the lower end side of the nozzle holder 4.

On an inner peripheral side of the bearing portion 33 of the retaining nut 6 is formed a through hole 35 having a diameter larger than the outside diameter of a cylindrical portion 17 of the nozzle body 3. Between a seating surface 36 of the shoulder portion 31 of the nozzle body 3 and an inner seating surface 32 of the bearing portion 33 of the retaining nut 6 is interposed a frictional force reducing member 9 for reducing a frictional force developed between the seating surfaces 36 and 32. The frictional force reducing member 9 is a flat plate-like friction mitigating component (it has a small in frictional coefficient), at least at an end face thereof located on the nozzle body side. A through hole 37 having a diameter larger than the outside diameter of the cylindrical portion 17 of the nozzle body 3 is formed along an inner periphery of the frictional force reducing member 9. The material of the frictional force reducing member 9 may be a metal having hardness equal to that of the nozzle body 3 and the retaining nut 6. The frictional force reducing member 9 may be made of resin. However, a frictional force reducing member 9 is likely to melt upon exposure to high temperature combustion gas(s). Thus, a metallic material may be more advantageous.

Next, the operation of the fuel injection nozzle 1 for an internal combustion engine according to this embodiment will be described below with reference to FIG. 1. A high-pressure fuel is fed from the common rail system as a high pressure source to the oil sump 12 formed around the nozzle needle 2 through the joint portion of the nozzle holder 4, then through the fuel feed passage 16 and the fuel delivery passage 15 formed in the nozzle body 3. When fuel is extracted from the hydraulic control chamber provided at the opposite end of the hydraulic piston, the hydraulic force in the oil sump 12 becomes larger than the urging force of the urging means such as a spring, so that the hydraulic piston and the nozzle needle 2 move in a direction to open the fuel injection hole. As a result, the high-pressure fuel present within the oil sump 12 is injected from the fuel injection hole into a combustion chamber in the diesel engine.

In the fuel injection nozzle 1 for an internal combustion engine according to this embodiment, as set forth above, a flat plate-like frictional force reducing member 9, which has a small frictional coefficient at both end faces thereof (on both of its sides), is interposed between the seating surface 36 of the shoulder portion 31 of the nozzle body 3 and the inner seating surface 32 of the bearing portion 33 of the retaining nut 6. Thereby, it is possible to reduce a frictional force developed between both seating surfaces 36 and 32 at the time of clamping the retaining nut 6. The clamping operation is for making the upper end-side close-contact surface of the nozzle body 3 and the lower end-side close-contact surface of the nozzle holder 4 come closely into contact with each other.

Therefore, even without performing a high-degree of surface machining on the inner seating surface 32 or even if the surface roughness of the inner seating surface 32 is large, there is no fear of the nozzle body 3 being twisted with a frictional force developed between the seating surface 36 of the shoulder portion 31 of the nozzle body 3 and the inner seating surface 32 of the bearing portion 33 of the retaining nut 6 at the time of tightening and fixing the internally threaded portion 22 of the retaining nut 6 to the externally threaded portion 23 of the nozzle holder 4. Consequently, it is possible to prevent deformation of the slide portion 7 of the nozzle needle 2 and hence possible to avoid a defective slide of the nozzle needle 2.

For diminishing the frictional coefficient of an end face of the frictional force reducing member 9, the end face is subjected to surface machining such as grinding to improve the surface smoothness. Alternatively, a friction mitigating agent such as grease is applied to the end face of the flat plate-like member. Both methods are easier to carry out than surface machining of the inner seating surface 32 of the bearing portion 33 of the retaining nut 6, thus permitting a reduction of cost.

Other Embodiments

The above embodiment of the present invention was applied to a sealing surface pressure improving structure of the fuel injection nozzle 1 for an internal combustion engine used as an injector in an accumulator type fuel injection system (a common rail system) provided with a high pressure supply pump and a common rail. However, the present invention may also be applied to a sealing surface pressure improving structure of a fuel injection nozzle for an internal combustion engine used as an injector in a fuel injection system wherein a high-pressure fuel is injected directly from an in-line fuel injection pump or a distribution type fuel injection pump to the injector. Then, a nozzle needle would open when a fuel pressure within an oil sump becomes higher than the urging force of an urging means such as a spring. The present invention is further applicable to a variable hole nozzle capable of changing the area of a fuel injection nozzle.

In the above embodiment, the close-contact surface of the nozzle body 3 and that of the nozzle holder 4 are brought into close contact directly with each other by virtue of the clamping axial force of the retaining nut 6 in order to ensure high-pressure sealability between the upper end-side close contact surface (sealing surface) of the nozzle body 3 and the lower end-side close contact surface (sealing surface) of the nozzle holder 4. However, both close-contact surfaces may be brought into close contact with each other through a chip packing by virtue of the clamping axial force of the retaining nut 6. That is, there may be adopted a fuel injection nozzle for an internal combustion engine with a chip packing disposed between the upper end-side close contact surface (sealing surface) of the nozzle body 3 and the lower end-side close contact surface (sealing surface) of the nozzle holder 4. In the chip packing is formed a fuel relay passage (communication passage) for communication between the fuel delivery passage 15 (first fuel passage) in the nozzle body 3 and the fuel feed passage 16 (second fuel passage) in the nozzle holder 4.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A fuel injection nozzle comprising:

a nozzle body having in its interior a first fuel passage for the supply of fuel to an oil sump;

a nozzle holder having in its interior a second fuel passage for the supply of fuel to the first fuel passage;

a retaining nut for making a contact surface of the nozzle body and a contact surface of the nozzle holder come into contact with each other using a predetermined clamping axial force to ensure a high-pressure seal between the first and second fuel passages, wherein the retaining nut has a bearing portion, the bearing portion having an inner seating surface opposed to a seating surface of a shoulder portion of the nozzle body; and a frictional force reducing member interposed between the seating surface of the shoulder portion of the nozzle body and the inner seating surface of the bearing portion of the retaining nut to reduce a frictional force developed between both seating surfaces at the time of clamping.

2. A fuel injection nozzle according to claim 1, wherein a flat plate-like member is used as the frictional force reducing member, the flat plate-like member having a small frictional coefficient at an end face thereof located on the nozzle body side.

3. A fuel injection nozzle according to claim 2, wherein a metallic member having a hardness equal to that of the nozzle body or the retaining nut is used as the flat plate-like member.

4. A fuel injection nozzle according to claim 3, wherein a flat plate-like member is a ring-like member whose outside diameter is approximately the same as an outside diameter of a nozzle body.

5. A fuel injection nozzle according to claim 1, further including a member disposed between and engaged with the nozzle body and the nozzle holder.

6. A fuel injection nozzle comprising:

a nozzle body having in its interior a first fuel passage for the supply of fuel to an oil sump;

a nozzle holder having in its interior a second fuel passage for the supply of fuel to the first fuel passage;

a retaining nut for making a contact surface of the nozzle body and a contact surface of the nozzle holder come into contact with each other using a predetermined clamping axial force to ensure a high-pressure seal between the first and second fuel passages, wherein the retaining nut encompasses the nozzle body and a portion of the nozzle holder during contact between the contact surface of the nozzle body and the contact surface of the nozzle holder; and a frictional force reducing member interposed between a seating surface of a shoulder portion of the nozzle body and an inner seating surface of a bearing portion of the retaining nut to reduce a frictional force developed between both seating surfaces at the time of clamping.

7. A fuel injection nozzle according to claim 6, further including a member disposed between and engaged with the nozzle body and the nozzle holder.

8. A fuel injection nozzle comprising:

a nozzle body having in its interior a first fuel passage for the supply of fuel to an oil sump;

a nozzle holder having in its interior a second fuel passage for the supply of fuel to the first fuel passage;

a retaining nut for making a contact surface of the nozzle body and a contact surface of the nozzle holder come into contact with each other using a predetermined clamping axial force to ensure a high-pressure seal between the first and second fuel passages, wherein the retaining nut encompasses the nozzle body and a portion of the nozzle holder during contact between the contact surface of the nozzle body and the contact surface of the nozzle holder; and a frictional force reducing member interposed between a seating surface of a shoulder portion of the nozzle body and an inner seating surface of a bearing portion of the retaining nut to reduce a frictional force developed between both seating surfaces at the time of clamping;

wherein the nozzle holder defines a first pin hole, the first pin hole being exposed along the contact surface of the nozzle holder.

9. A fuel injection nozzle according to claim 8, wherein the nozzle body defines a second pin hole, the second pin hole being exposed along the contact surface of the nozzle body and aligned with the first pin hole of the nozzle holder.

10. A fuel injection nozzle according to claim 9, wherein the fuel injection nozzle contains a dowel pin disposed with the first pin hole and the second pin hole in order fix the position of the nozzle holder and the nozzle body relative to each other.

* * * * *